US009470228B2

(12) United States Patent
O'Connor

(10) Patent No.: US 9,470,228 B2
(45) Date of Patent: Oct. 18, 2016

(54) MULTIPLE SEGMENT LOBE PUMP

(71) Applicant: Brian J. O'Connor, San Diego, CA (US)

(72) Inventor: Brian J. O'Connor, San Diego, CA (US)

( * ) Notice: Subject to any disclaimer, the term of this patent is extended or adjusted under 35 U.S.C. 154(b) by 244 days.

(21) Appl. No.: 13/917,560

(22) Filed: Jun. 13, 2013

(65) Prior Publication Data

US 2014/0010698 A1 Jan. 9, 2014

Related U.S. Application Data

(60) Provisional application No. 61/667,556, filed on Jul. 3, 2012.

(51) Int. Cl.

| | |
|---|---|
| ***F04C 2/12*** | (2006.01) |
| ***F01C 17/02*** | (2006.01) |
| ***F01C 21/10*** | (2006.01) |
| ***F04C 11/00*** | (2006.01) |
| ***F04C 14/02*** | (2006.01) |
| ***F04C 15/00*** | (2006.01) |

(52) U.S. Cl.

CPC ..... *F04C 2/126* (2013.01); *F04C 2/12* (2013.01); *F04C 11/001* (2013.01); *F04C 14/02* (2013.01); *F04C 15/0049* (2013.01); *F01C 17/02* (2013.01); *F01C 21/108* (2013.01); *F04C 2240/20* (2013.01)

(58) Field of Classification Search

CPC .... F01C 17/02; F01C 21/108; F04C 11/001; F04C 14/02; F04C 15/0049; F04C 2240/20; F04C 2/12; F04C 2/126; F04C 11/005

USPC ..... 418/205, 197, 201.1, 206.1, 206.7, 418/201.3, 114

See application file for complete search history.

(56) References Cited

U.S. PATENT DOCUMENTS

| | | | | |
|---|---|---|---|---|
| 2,360,833 | A * | 10/1944 | Hammond | F04C 2/126 418/114 |
| 5,195,882 | A | 3/1993 | Freeman | |
| 5,554,020 | A * | 9/1996 | Rao | F01C 21/104 418/178 |
| 6,398,528 | B1 | 6/2002 | Hansen et al. | |
| 6,817,487 | B2 | 11/2004 | Ross | |
| 7,238,067 | B2 | 7/2007 | O'Connor | |
| 8,323,011 | B2 | 12/2012 | Yang et al. | |
| 2003/0086804 | A1* | 5/2003 | Suman | F04C 18/086 418/178 |
| 2008/0193316 | A1* | 8/2008 | Fujii et al. | 418/201.3 |
| 2009/0042464 | A1 | 2/2009 | O'Connor | |
| 2010/0202912 | A1* | 8/2010 | Park | F04C 18/126 418/181 |
| 2010/0226808 | A1* | 9/2010 | Schofield | F04C 18/126 418/206.6 |
| 2011/0223051 | A1 | 9/2011 | Giuseppe | |

* cited by examiner

*Primary Examiner* — Nicholas J Weiss
*Assistant Examiner* — Paul Thiede
(74) *Attorney, Agent, or Firm* — Mark Wisnosky

(57) ABSTRACT

Designs for multiple segment lobe pumps are shown. The designs include pumps using rotors having two lobes to a plurality of lobes and segments that include two segments to a plurality of segments. Designs for both vertical or straight walled conventional lobed rotors as well as helical lobe rotors are shown. The designs are applicable to a variety of rotors and number of segments. In one particular case the designs enable a three lobe helical pump.

12 Claims, 18 Drawing Sheets

MULTIPLE SEGMENT LOBE PUMP

CROSS-REFERENCE TO RELATED APPLICATIONS

This application claims the benefit of U.S. Provisional Patent Application 61/667,556, filed Jul. 3, 2012, entitled "Multiple Segment Lobe Pump", by the same inventor, and incorporated by reference.

BACKGROUND OF THE INVENTION

1. Technical Field

The present invention relates to a multiple segment lobe pump with reduced or zero pulsations in the outflow.

2. Related Background Art

The first lobe (air) pump was invented in 1854 by a couple of wood mill owners in Connersville, Ind. named Francis and Philander Roots and became known as 'The Roots Blower'. The design featured two side-by-side rotors that were each shaped sort of like a two dimensional hour glass. As the rotors turned, each delivered a 'puff' of air, twice per revolution. The blower was intended to produce the intermittent volume of air flow for uses in their mill. In the early 1900's, engineers at the Howard Pump Company in Eastbourne, England realized that if the blower were to run at a relatively low speed, it could forcibly transport a volume of incompressible media, such as liquids or semi-solids, between two locations. With that discovery, the first lobe (transfer) pump was born.

Up until the early nineteen-seventies, the pumping mechanism of the lobe pump consisted of two parallel shafts, each fitted with a single rotor that had multiple lobes with a profile that was parallel to the axis of rotation of the respective shaft. In other words, the lobes were straight sided. Depending on the application, the number of mating lobes was usually two or three and in some cases four. However, such pumps produce flow pulsations that are undesirable in many applications and as a result, have limited their wide spread use. By its design a lobe pump is a positive displacement pump. It is capable of pumping a wide variety of liquids, gels and granular materials. Current lobe pump applications include the transport of polymers, paper coatings, surfactants, paints, adhesives and a large variety of food applications such as; berries, fruits, chopped vegetables, cereals, grains and many other food products.

Starting in the mid-1970's with the advances in machining methods, the helical lobe pump was developed. The curved nesting lobe design significantly reduced the magnitude of the pulses but did not eliminate the non-continuous pump flow characteristic. In recent years, several manufacturers realized that a continuous flow, pulsation free helical lobe is possible by increasing the 'pumping chamber isolation region' so as to include the extent of the helical wrap of each lobe.

Currently, four and five helical lobe, non-pulsating pumps are available from several manufacturers. In order for these pumps to be pulsation free, the housing design must provide a 'pump chamber isolation region' (PCIR) that spans the separation angle between the lobes plus the helical wrap angle. In the case of a four lobe design, the angular lobe separation angle is 90° and the helical wrap angle must be 90° requiring a PCIR of 180°. The distance between the two sealing arcs is, by physical geometry equal to the center distance between the two shafts. The inlet and discharge flow area is therefore equal to the rotor height times the distance between the two shaft centers.

A three helical lobe, non-pulsating pump is currently not manufactured because of the geometric limitations related to the PCIR. A three lobe design has a lobe separation angle of 120°. Adding the wrap angle required to seal a volume of flow within the pumping cavity and provide continuous pulse free flow, requires a PCIR of 240° resulting in an unworkably small inlet and discharge opening.

There is a need for designs of straight lobe pumps with reduced pulsation in the outflow. There is a need for helical lobe pumps that provide wider inlet and outlets on the pump housing. There is a need for a design that enables two and three lobe helical lobe pumps. There is a need for lobe pump designs that allow flexibility in choosing the size of the pumping chamber and the inlet and outlet dimensions of the pump. There is a need for a pump that retains all of the desirable features of a single segment lobe pump, which include the ability to handle viscous fluids, mixed media (liquid and solid) and semi-solids while providing continuous, low pulsation or pulsation-free flow.

DISCLOSURE OF THE INVENTION

The invention is directed to a means of eliminating the flow pulsations in the flow of the lobe pump in order to generate a steady, continuous discharge flow. One embodiment incorporates two or more co-axial pump segments on each drive shaft. Each pump segment on the shaft is identical to the adjacent segment and is an independent, full function pump device. Each of the segments of the multi-segment lobe pump runs in parallel, each producing the same flow. As such, there is no fluid dynamic similarity to a 'staged' rotor-dynamic pump that may have multiple rotors on the same shaft that run in 'series' in order to generate an increase the hydrostatic pressure. Embodiments include two, three and more lobes per rotor in combination with two, three and more segments.

The individual pumps are positioned with a predetermined angular offset with respect to the lobes in each succeeding segment. Since the flow of each segment is additive, the timing of the segments eliminates the cyclic variation in the total flow resulting in smooth, continuous discharge flow. In one embodiment a three straight sided lobe pump configuration with five pump segments per shaft, reduces the flow pulsations at both the inlet and discharge to less than one-percent of the total flow.

In another embodiment, timing gears set the angular position of each rotor. In one embodiment a first shaft is driven by an outside source and the second shaft is precisely driven relative to the first shaft. In addition, the timing gears position the individual rotors very precisely so that the individual rotors within a segment never touch.

In another embodiment multiple lobe, multiple segment pumps are made using helical lobe rotors.

MODES FOR CARRYING OUT THE INVENTION

Figure 1:
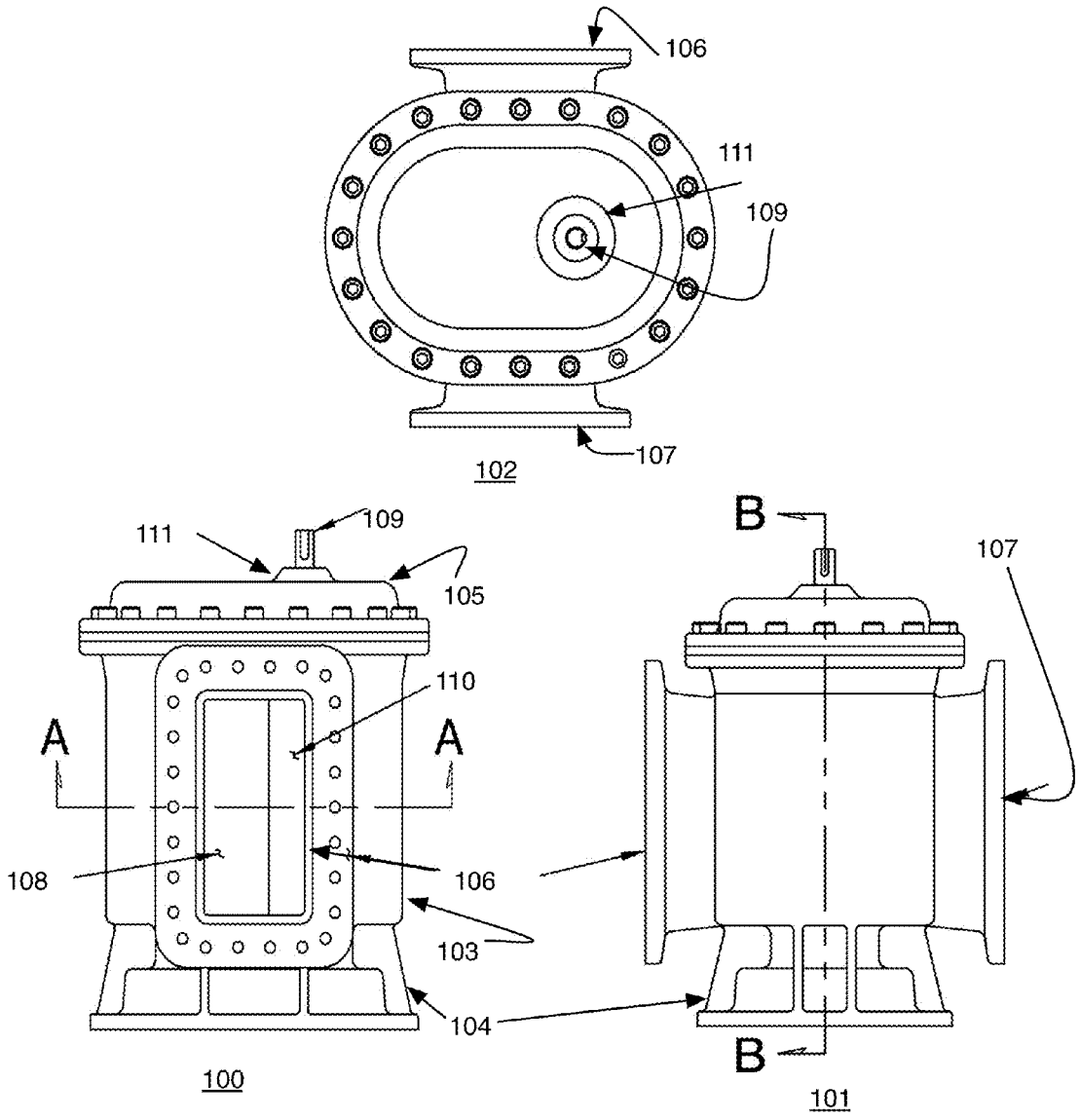
FIG. 1 shows the exterior elements of a pump.
Figure 4:
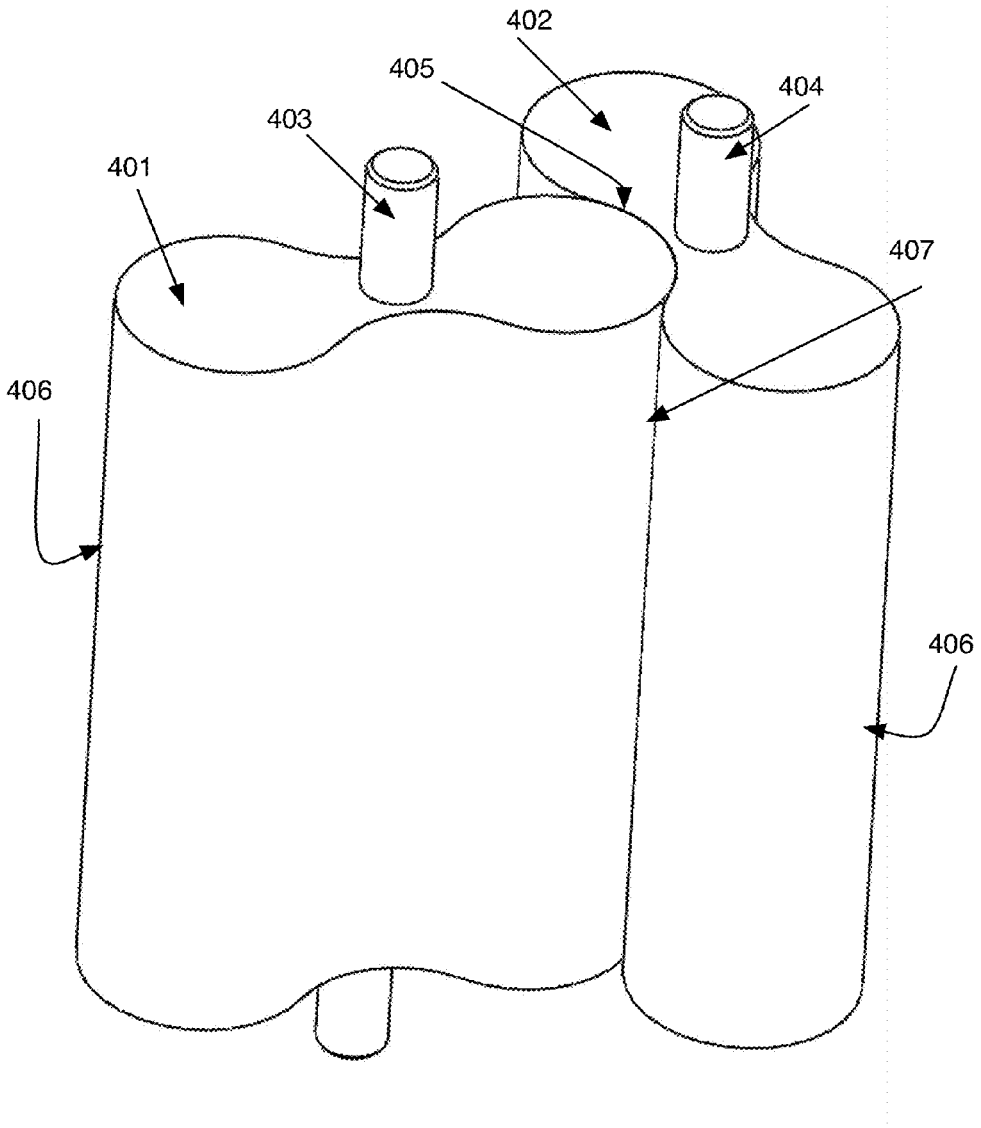
FIG. 4 is a view of a pair of two lobe rotors.
Figure 5:
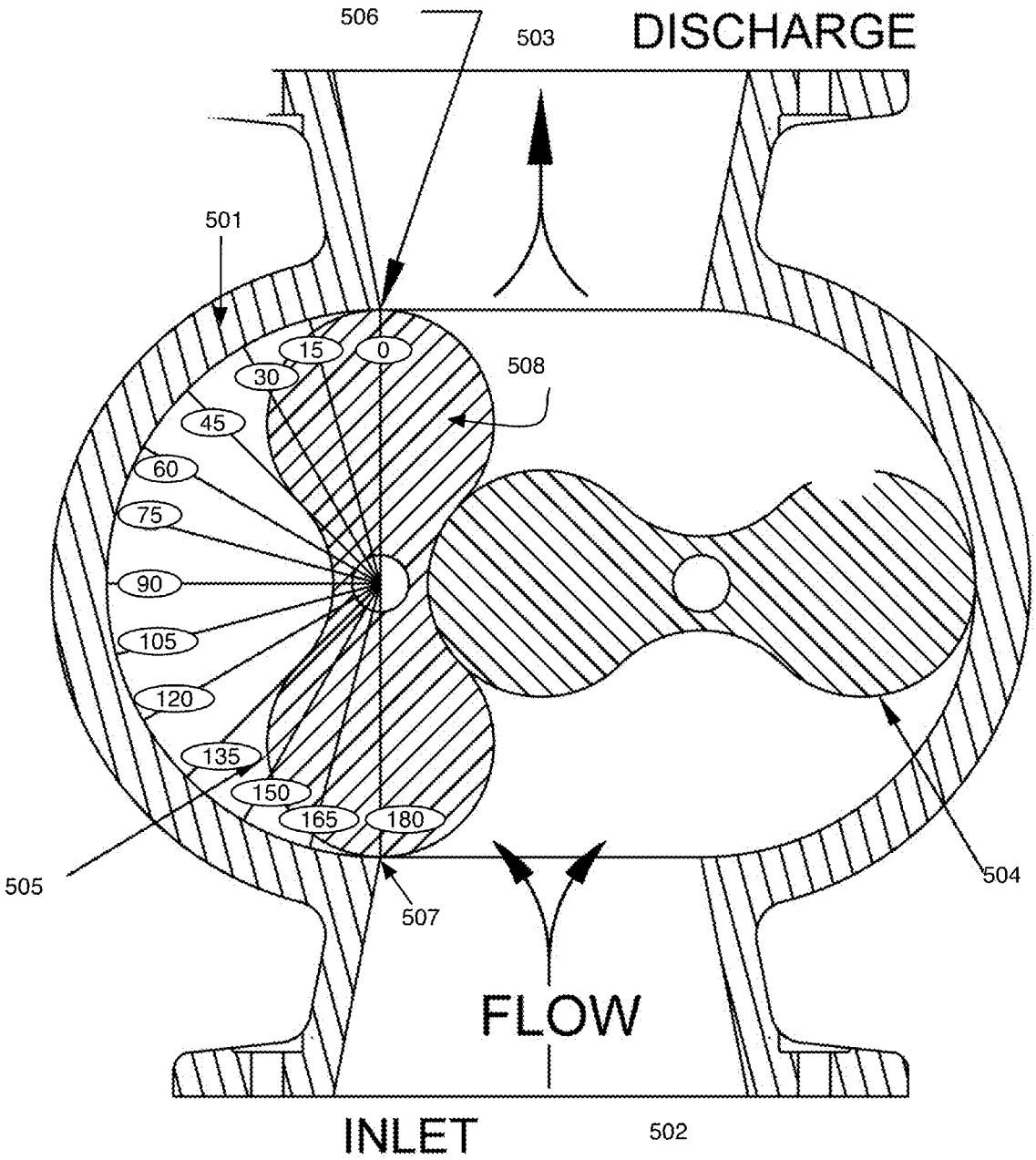
FIG. 5 is a cross-sectional view of a two lobe pump as shown in FIG. 3 with additional angular indicia.
Figure 6:
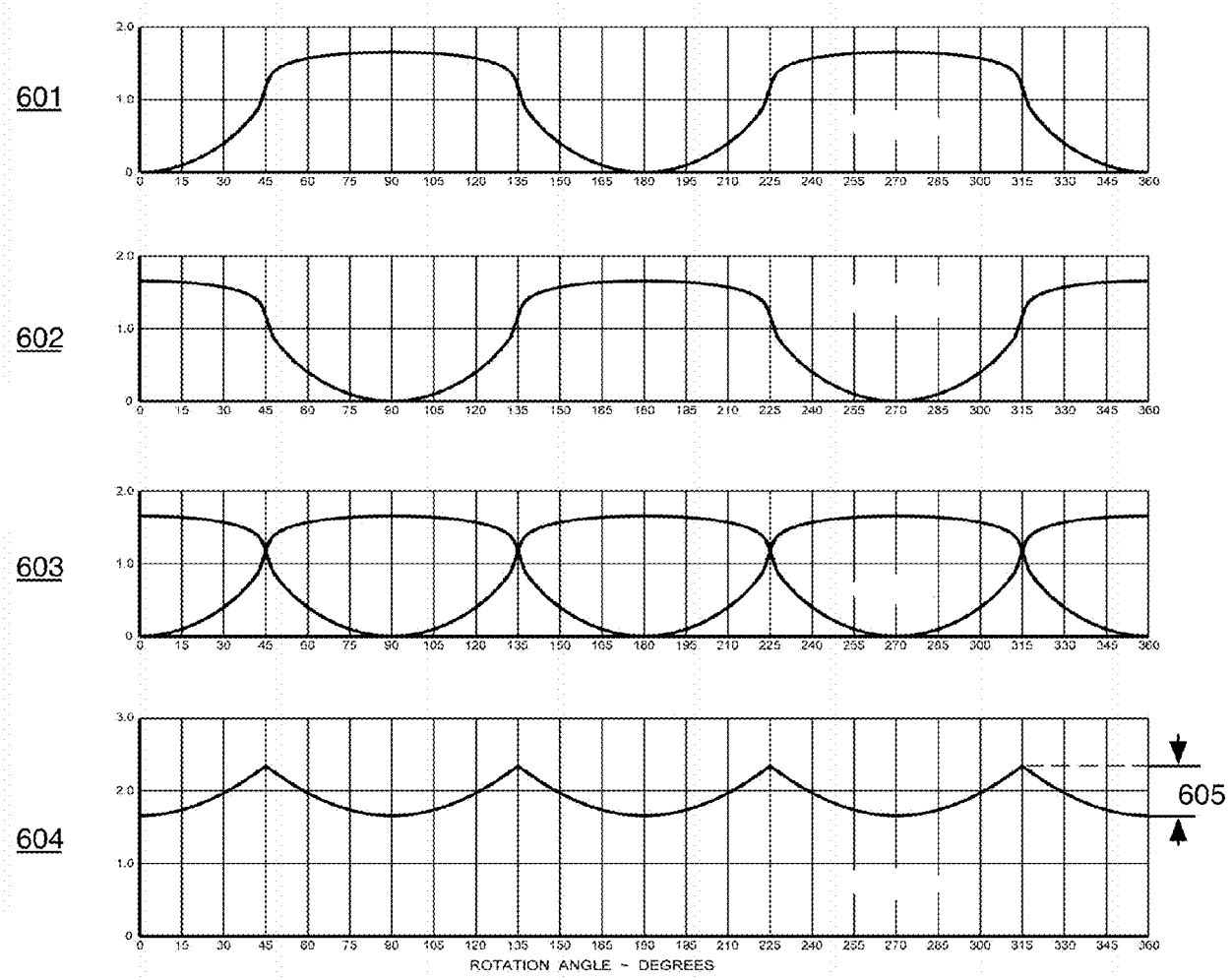
FIG. 6 shows graphs of the outflow from two lobe single segment pumps equivalent to that shown in FIG. 5.

To fully explain how the basic prior art lobe pump operates, and to help explain the instant invention by contrast, FIGS. 1-6 are included that show several views of a prior art lobe pump. It should be understood and apparent however that some components and descriptions are common to both the prior art pumps and embodiments of the current invention. As an example both the prior art and the current invention include housings, inlets, outlets and at least a pair of rotors. Descriptions specific to embodiments of the instant invention, for brevity, avoid repeatedly restating these common features. The pump has two side-by-side rotors, each with two identical sets of lobes. FIG. 1 illustrates the three primary exterior views of the machine. FIGS. 2-5 illustrate interior sections and components. FIG. 6 shows a measure of performance.

Referring now to FIG. 1 a typical exterior housing for pumps of both prior art design and the current invention is shown. Three views are shown in the figure: a side view 100, a second side view 101 and a top view 102. The pump is seen to include a housing 103, the housing including a base 104 and a top 105. In the instance shown the top 105 is seen to be bolted onto the main body of the housing 103. The housing further includes openings 106, 107 for inflow and outflow. Although typically designating one opening 106 for inflow and the other 107 for outflow it should be understood that the pump designs discussed below are symmetrical and either opening could be used for inflow or outflow or both if the pump is run in the reverse direction. The face 108 of a first rotor and the edge 110 of a second rotor can be seen through the opening 106. The housing further includes a passage 111 through which a drive or input shaft 109 protrudes. The pump is driven through rotation of the shaft 109 typical using a motor (not shown). The indicia AA and BB show lines through which cross sectional views of the pump are taken. The cross sectional views shown in FIGS. 2 and 3 respectively.

Figure 2:
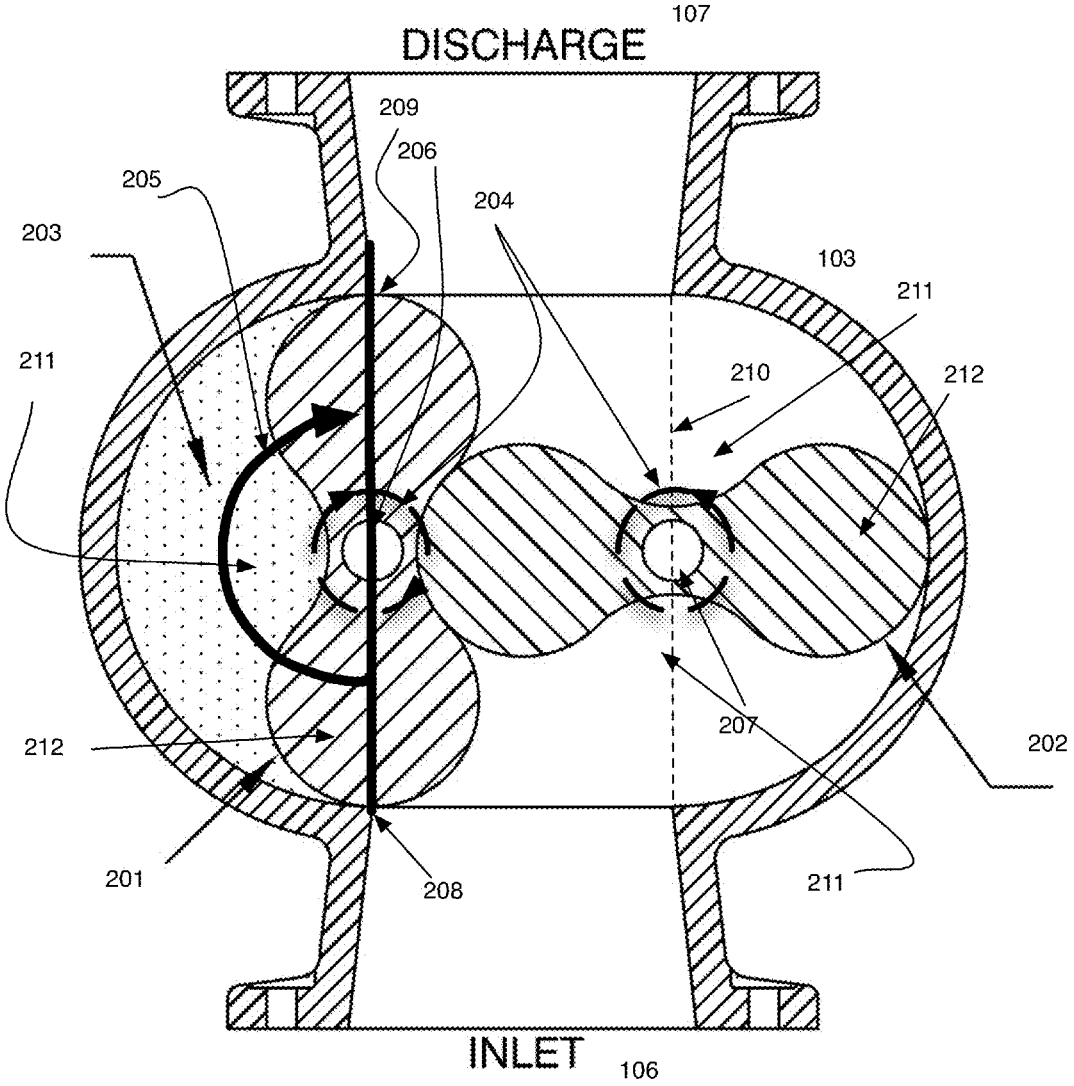
FIG. 2 is a cross sectional view of a two lobe single segment pump as known in the art.

Referring now to FIG. 2, The AA cross section of the pump of FIG. 1 is shown. The pump is seen to be comprised of a housing 103 including an inlet 106 and an outlet 107. The interior of the pump is comprised of two lobe rotors 201 and 202 the rotors rotate in the directions 204 shown. Rotation of the individual rotors is through use of timing gears (not shown) attached to the shafts 206, 207. The rotors are likewise attached to the shafts 206, 207 and rotation of the shafts rotates the rotors. The pump chamber isolation region (PCIR) 203 is defined by the housing, rotor and the points 208, 209 where the rotor meets the housing. There is a symmetrically identical PCIR for the second rotor 202 bound by the line 210. The shafts and the rotors are positioned such that the simultaneous rotation of the rotors results in meshing of the rotors thereby causes a pumping action wherein a fluid enters a central portion of each lobe 211 at the inlet of the housing, passes through a pump chamber isolation region, and the fluid is displaced from each lobe at the outlet by the bulbous end 212 of the second lobe. Thereby resulting in a positive displacement pumping action. Although defined as a region, the PCIR is measured by the angle 205. In the example shown the PCIR would be quantitatively described as 180°. In a straight walled, conventional, lobe pump the PCIR is equal to the angle between the lobes of the rotor. In the case shown the angle between the lobes for a two lobe rotor is 180°. Or more generally the angle between the lobes of a multiple lobe rotor is 360°/number of lobes. Thus a single segment lobe pump made with a three lobe rotor would have a PCIR of 120°.

Figure 3:
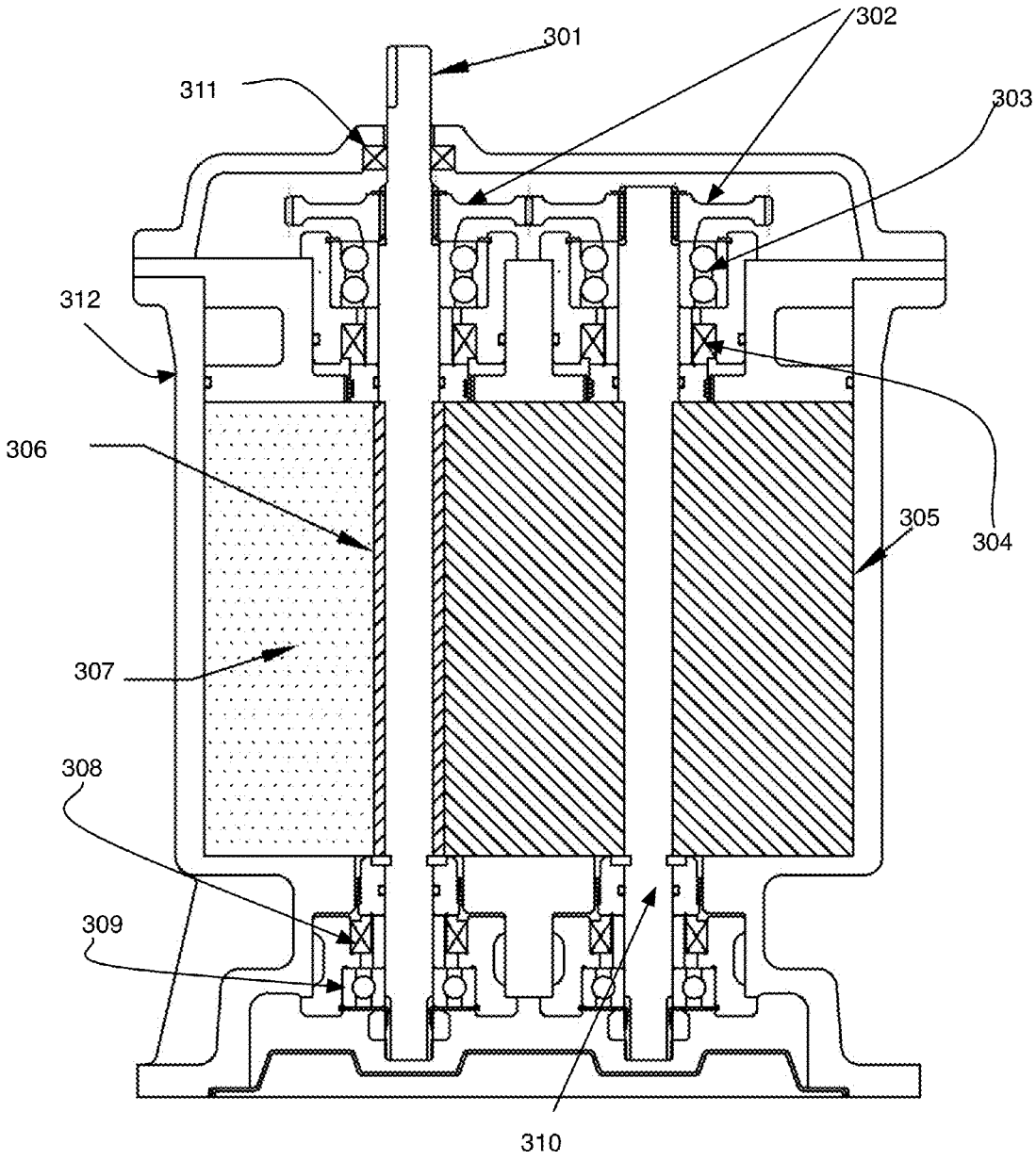
FIG. 3 is a second cross-sectional view of a two lobe single segment pump as known in the art.

Referring now to FIG. 3, further components of the lobe pump are seen in this cross section along the line BB of FIG. 1. The pump is seen to comprise dual rotating shafts 301, 310. A first shaft 301 is the power input shaft, which is driven by an electric motor or other means. Power is transmitted to the second shaft 310 by means of timing gears 302 which are rigidly affixed to each shaft. Rotors 305, 306 are concentric with and rigidly affixed to their respective shafts 301, 310. The rotors are cross hatched and shown parallel to one another in the same position as seen in FIG. 2. Each shaft is positioned and held in place by ball bearings: an upper bearing 303 and a lower bearing 309. In order to prevent fluid from entering the region of the bearings, mechanical shaft seals 304, 308 are mounted in the housing 312. An additional seal 311 is seen at the top of the power input shaft 301. Each rotor is precisely machined so that when they are mounted in their respective bearings and positioned by the timing gears, a very close, uniform clearance is established between the two rotors as well as each rotor and the wall of the housing. There is no metal to metal or rotor to metal or rotor to rotor contact between components. The PCIR 307 is also shown. All components are contained within the sealed housing 312. In a preferred embodiment for every full 360° rotation of the drive shaft 301, each rotor also rotates 360° thereby delivering four discrete volumes from the two pump chamber isolation regions of liquid per revolution into the inlet side and discharge out the outlet side of the pump. In other embodiments there is additional gearing between the input shaft 301 and the shafts 310 that drive the rotors such that a full rotation of the input shaft may result in more or less than a full rotation of the shafts 310. Pumps that are made using different number of lobes would deliver correspondingly different numbers of volumes from the PCIR. As an example an equivalent three lobe pump would deliver 6 volumes per rotation.

The isolated lobe rotors are shown in FIG. 4. The rotors 401, 402 are each seen to be mounted on shafts 403, 404.

The point of nearest approach 405 of the rotors is maintained as nearly fluid tight by machining and precise movement of the rotors relative to one another by the timing gears, not shown. The timing gears would mount on the shafts at the approximate locations 403, 404 shown. The rotors shown are termed straight wall or conventional rotors as the sides of the rotors as shown are vertical and the point where the meet 407 is a straight line. The rotors 401, 402 in this embodiment are identical. This is in contrast to helical rotors, discussed later, where the rotors are twisted into a helical shape and the paired rotors are mirror images of one another.

Referring now to FIG. 5 an index 505 is shown that is used in subsequent examples to discuss the outflow performance of the pumps. The index measure the angle of rotation of the input shaft and the rotors. A complete pumping cycle is defined as 360° rotation of the index shown. Each rotor would deliver two PCIR volumes for every 360° rotation. The PCIR being defined as the region isolated between the rotor 508 and the housing 501. The outer points 506, 507 define the boundaries of the PCIR. The flow is characterized in that for every 360 degrees of the index, four PCIR volumes would enter 502 and four PCIR volumes would exit 503. It should be noted the pumps are symmetrical and could also be run in reverse thereby reversing the flow.

Referring now to FIG. 6, four graphs of the output of the dual lobe pump described and illustrated thus far is shown. The horizontal X-axis is the index as described in FIG. 5 and ranges from 0° at the left to 360° at the right. The vertical axis in each graph represents flow out from the pump. The top graph 601 show the flow due to the first rotor. The next graph 602 shows the flow from the second rotor. The third graph 603, shows the two flows superimposed and the fourth graph 604 shows the flows summed and represents the total flow out of the pump. The problem with pulsation of conventional lobe pumps is readily apparent where the peak to valley variation 605 is about 25%.

Multiple Segment Pumps

Figure 7:
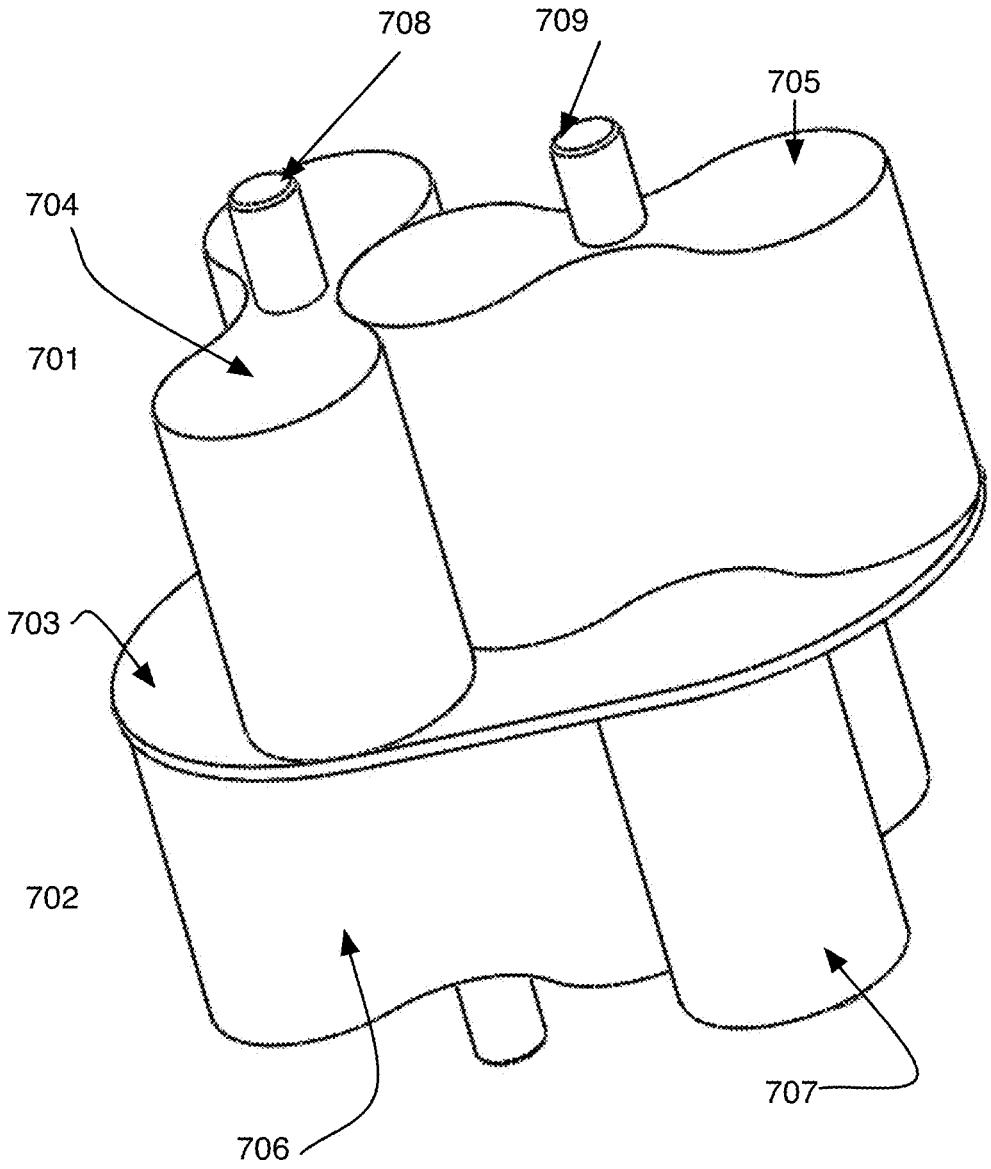
FIG. 7 is a view of the rotors for a two segment two lobe pump embodiment of the present invention.

The rotors for a multiple segment lobe pump embodiment of the present invention are shown in FIG. 7. The pump is comprised of the housing and other attributes already discussed. The pump is further comprised of four rotors 704, 705, 705, 707 the rotors are contained in two separate segments 701 and 702 the segments are separated by a separator plate 703. The separation plate is in place between each set of nested rotors in order to isolate the pump segments from each other. The plate 703 is floating between the rotors and perpendicular to the rotating shafts 708, 709. It is positioned by a close fit with between the semi-circular ends and the opposing semi-circular recesses in the pump housing. The plate also has dual circular openings that allow the shaft and a circular hub portion of each rotor to pass through. The openings are not visible in the figure since they are hidden under the lobe rotor elements. The dual openings fit in close proximity to the circular hub to minimize transverse leakage between the segments. Each segment act as an additional lobe pump made up of dual nesting rotors and a seal plate to prevent flow between the segments.

The rotors are fixed to rotating shafts 708, 709. The rotors 704, 706 are affixed to the same shaft 708 and the rotors 705, 707 are fixed to the same shaft 709. The rotors attached to the same shaft are offset by an index angle described in FIG. 8. In the example shown the in FIG. 7 the index angle between rotor 704 and rotor 706 is set at 90 degrees. The same is true of the index angle between the other set: rotor 705 and rotor 707. The rotation of the separate shafts is synchronized through use of timing gears attached to the shafts 708, 709.

Figure 8:
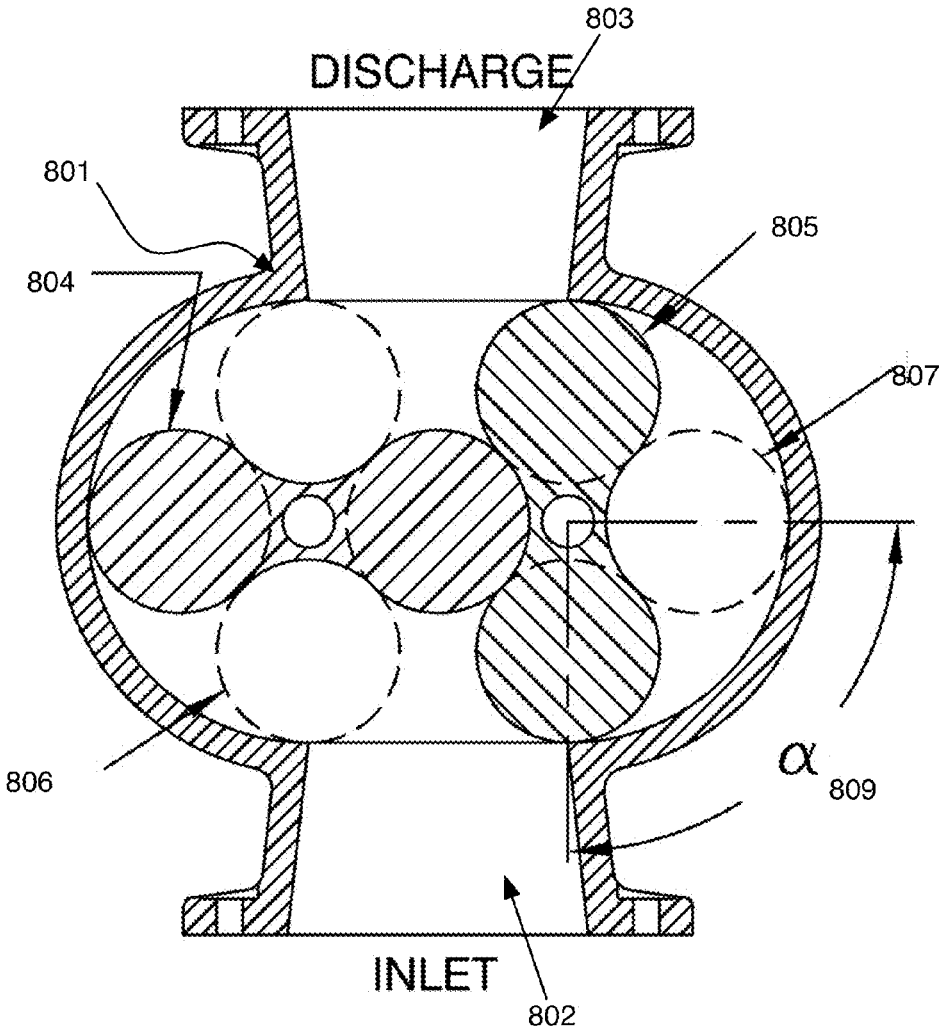
FIG. 8 is a cross sectional view of a two segment two lobe pump embodiment.

A cross-sectional view of a two segment lobe pump utilizing the rotor assembly shown in FIG. 7 is seen in FIG. 8. The pump is comprised of a housing 801 having an inlet 802 and an outlet 803. Located within the housing are two pump segments each using two lobe rotors. The rotors are located on either side of a separation plate not seen here but shown in FIG. 7. The rotors 804 and 805 on a first side of the separation plate and the rotors 806, 807 are on a second side of the separation plate. The rotors are separate segments are fixed relative to one another and displaced by the index angle 809. In the case shown the index angle is 90°. In a preferred embodiment the index angle for a multi-segment straight sided lobe pump is equal to the angular separation between the lobes divided by the number of segments. In the instant case, the angular separation between the lobes is 180°. There are two segments and therefore this preferred case has an index angle between the lobes on separate layers of 180/2 or 90°.

Figure 9:
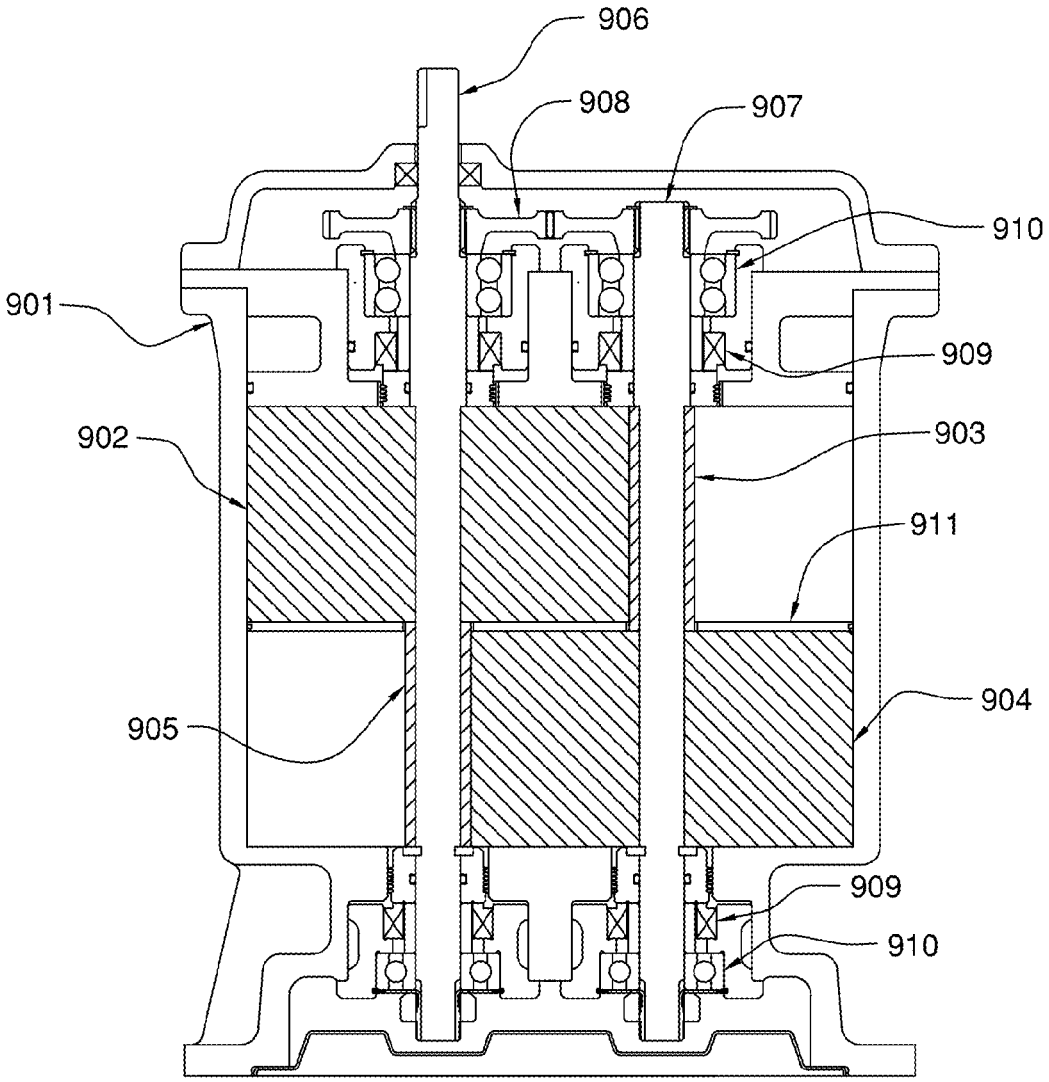
FIG. 9 is a second cross-sectional view of a two segment two lobe pump embodiment.

An additional view of a two segment lobe pump discussed in FIGS. 7 and 8 is shown in FIG. 9. The pump is comprised of a housing 901 which encases a first segment comprised of lobe rotors 902, 903 and a second segment comprised of rotors 904, 905. The segments are separated by a separation plate 911. The Rotors are fixedly attached to shafts 906, 907. The first shaft 906 extends beyond the housing and acts as an input shaft to power the pump. The second shaft 907 is encased within the housing. The rotation of the shafts is synchronized through use of timing gears 908 attached to each shaft such that upon rotation of the input shaft the second shaft 907 is rotated in a precise synchronization with the first shaft. The precise synchronization is required to synchronize the motion of the first lobe rotor 902 with the motion of the second lobe rotor 903 both located in the first segment as well as to synchronize the motion of the third lobe rotor 904 with motion of the fourth lobe rotor 905 both located in the second segment. These timing gears set the angular position of each rotor with one shaft driving and the other shaft is driven. In addition, the gears position the individual rotors very precisely so that they never actually touch. The pump further includes seals 909 to prevent leakage into the bearings and bearings 910 to hold the shafts in place. The inlet and exit ports of the pump are not visible in this view.

Figure 10:
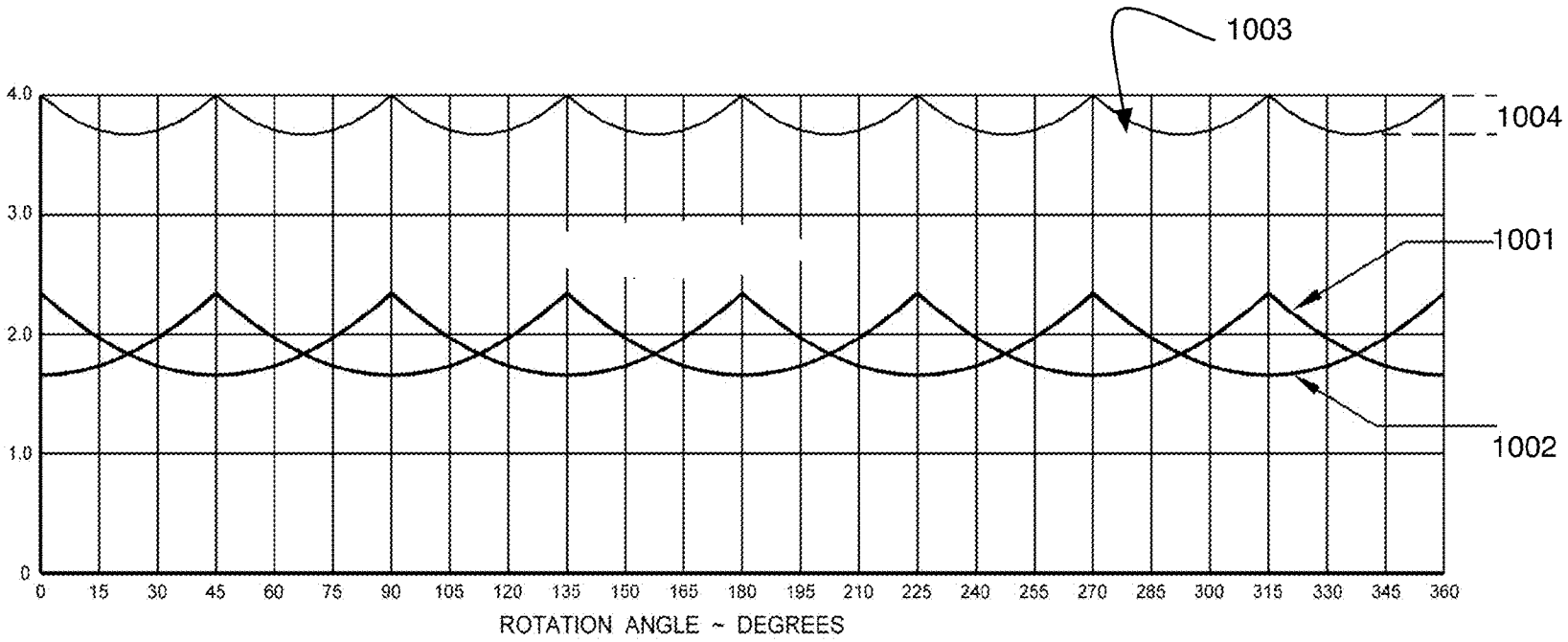
FIG. 10 is a chart of the outflow of a two segment two lobe pump embodiment.

The outflow performance of the two segment dual lobe pump is shown in FIG. 10. The individual segments perform as individual pumps with negligible leakage between segments. The output of the multiple segment pump is therefore the sum of the output of each segment. The effect on inlet and discharge pulsation of the dual segment, dual lobe pump is shown in the upper plot 1003 that represents the summation of the instantaneous area change of the indexed segments added together. The flow of individual segments are shown in the lower curves 1001, 1002. As the instantaneous area curve indicates, there is only about a 5% variation in instantaneous area compared to the 25% variation with a single segment pump as shown previously in FIG. 6.

Outflow performance can be improved more with the addition of segments. In each case the total flow is the sum of the flow from each segment. The index angle between the lobes on different segments is set to equal the angle between the individual rotor lobes divided by the number of segments. In the case shown in the FIGS. 7, 8 and 9 a two segment dual lobe pump has a 180 degree angular separation between lobes on an individual rotor and the lobes on adjacent layers in a two segment are indexed by 90°. In the case of a three segment, dual lobe pump with two lobes per individual rotor, the segments would be indexed sixty degrees from each other. If there were four pump segments, the index angle of the segments on each shaft would equal forty-five degrees, etc.

Figure 11:
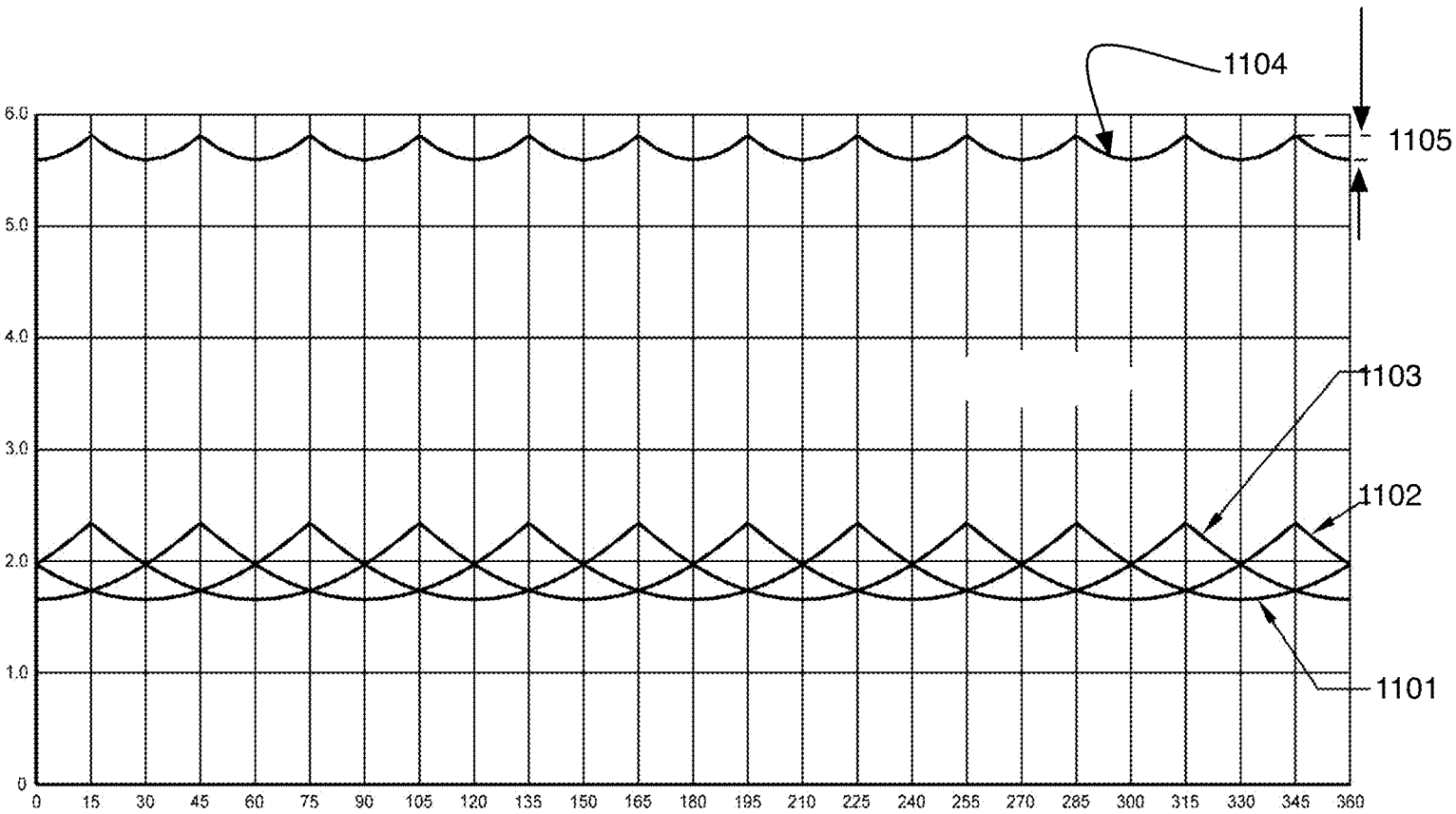
FIG. 11 is a chart of the outflow of a three segment two lobe pump embodiment.

The addition of another pump segment to create a three segment dual lobe pump would have a flow variation of 3.9%. Performance of such a pump is shown in FIG. 11 the bottom curves 1101, 1102, 1103 show the outflow (y axis) as a function of angular rotation (x axis) for each segment. The top curve shows the output of the pump as the summation of these three lower curves. Similarly a four segment pump version would have a flow variation of 2.1%.

The invention is not limited to two lobe pumps. Embodiments include three four and more lobes on the individual rotors. The same design principals already discussed apply. A three lobe pump would have a 120 degree separation between lobes. The pump chamber isolation region for straight wall lobes would be 120 degrees. The same as the angular separation of individual rotors. In a two segment three lobe pump the rotors on adjacent levels would be indexed by 60°. That is as already described the rotors on adjacent levels are indexed by the angle between lobes divided by the number of segments or 120/2=60°. Analysis of the flow profiles equivalently to what has been shown indicates that a three lobe, two segment pump can reduce the pulsation effect of the single segment pump from 35.1% to 10.0% while a three segment, three lobe rotor geometry will reduce the pulsation intensity from 35.1% to 5.2%. A five segment, three lobe pump, shown in FIG. 12, will reduce the intensity of pulsation down to less than 1%.

Figure 12:
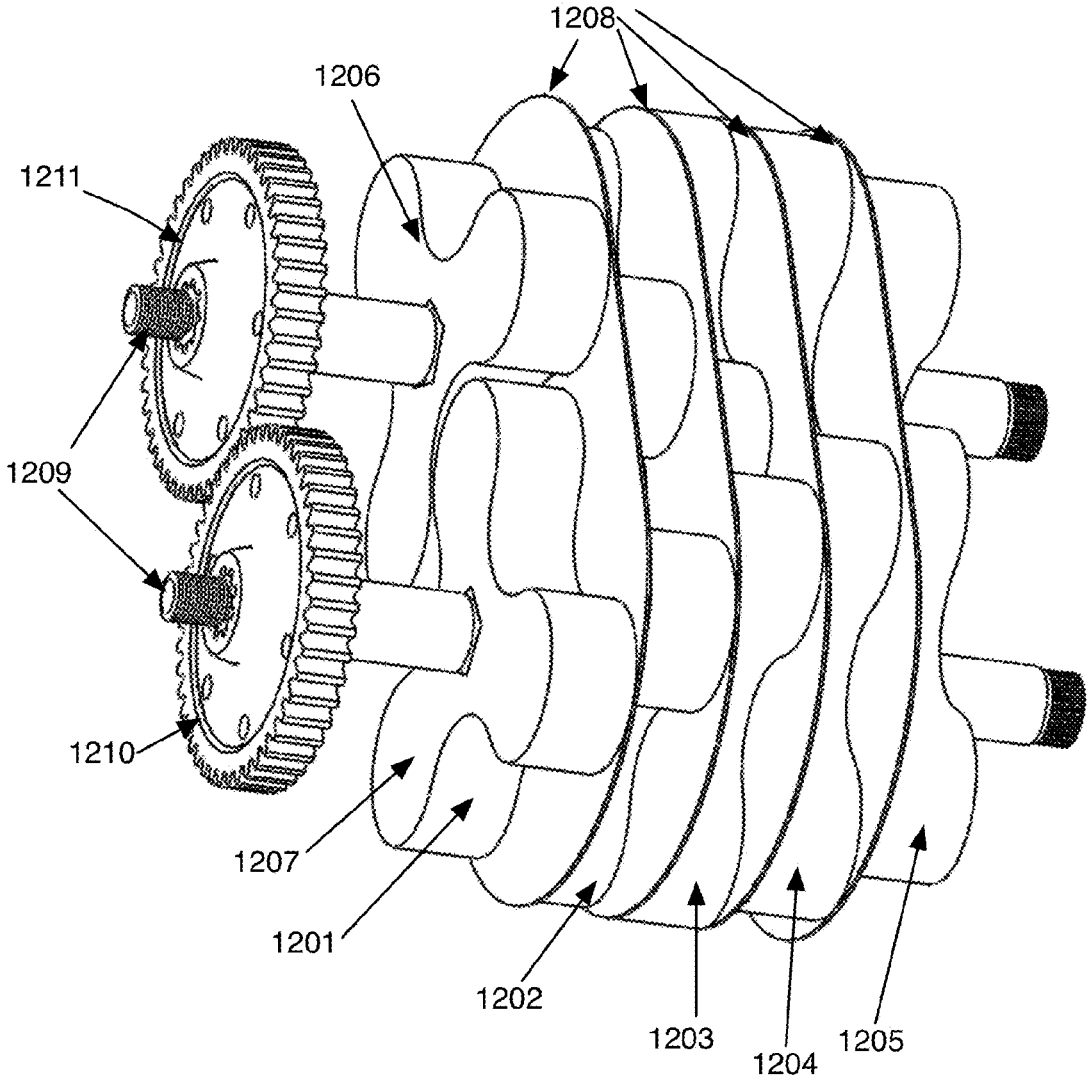
FIG. 12 shows the interior pump rotor assembly for a five segment three lobe pump.

Referring to FIG. 12, the components of a pump having both a plurality of lobes on each rotor and a plurality of segments are shown. Such a pump would have features in common with those already discussed such as a housing and inlet and outlet ports. In the embodiment shown there are two three-lobe rotors in each segment. A first, top, segment 1201 is seen to be comprised of two rotors 1206, 1207. Similarly the other segments 1202, 1203, 1204, 1205 each also contain a pair of rotors. The segments are separated by separation plates 1208. The rotors are mounted on shafts 1209 that when rotated cause the rotors to also rotate. Attached to the shafts are timing gears 1210, 1211 that synchronize the relative motion of the two rotors such that the lobes mesh during rotation and form a close but non-contact seal between the two lobes on the same segment but different shafts. In this case the rotors on the second segment 1202 from the top segment 1201 are indexed relative to the rotors on the top by 24 degrees. This is, as already discussed, the angle between the lobes of an individual rotor divided by the number of segments. Here that is 120° divided by 5 segments or 24° indexing of rotors between adjacent levels.

Figure 13:
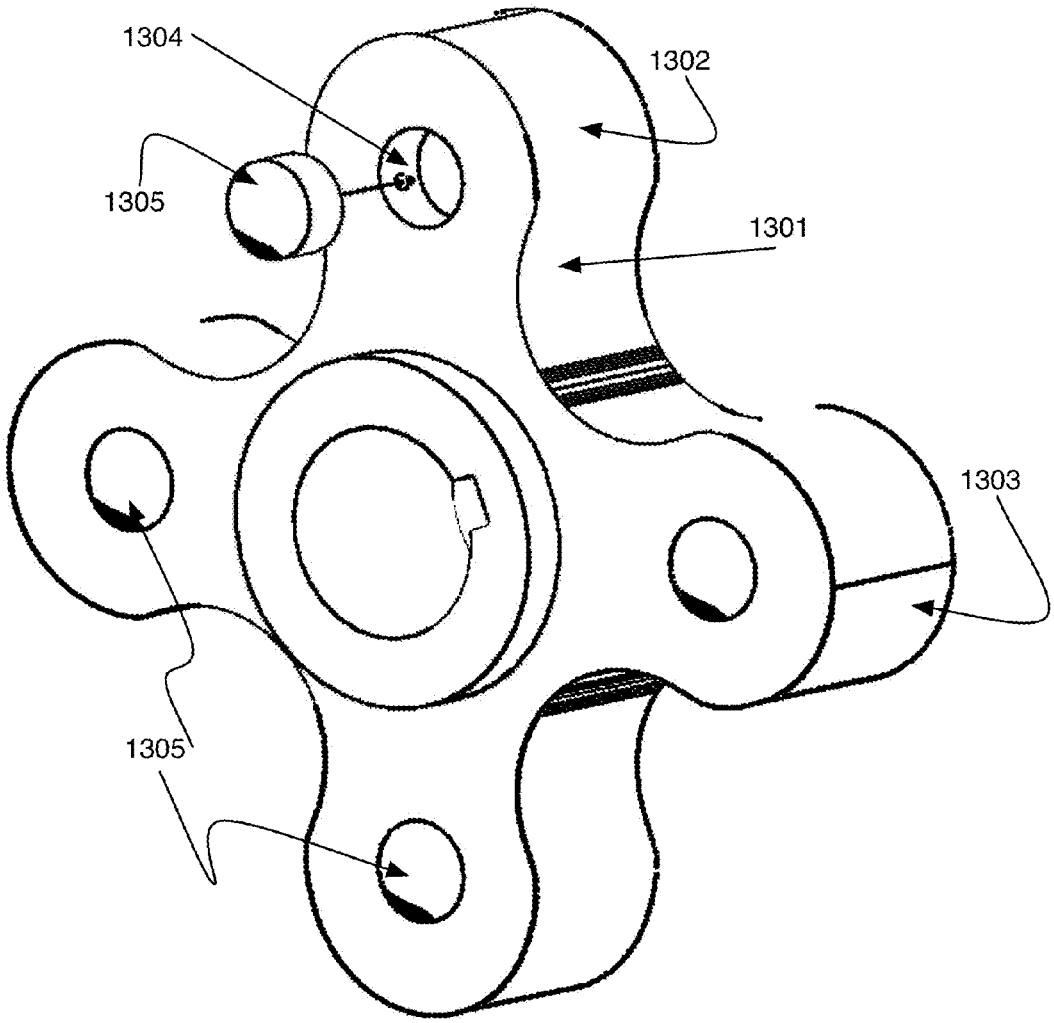
FIG. 13 show the rotor for a four lobe pump including anti-friction plugs.

Similarly, four lobe multi-segment pumps can also be constructed. A four lobe, four segment pump geometry would reduce the pulsation intensity from a one segment intensity of 13.6% down to 0.20%. A rotor 1301 for a four lobe pump is shown in FIG. 13. The rotor is comprised of four individual lobes, two of which 1302, 1303 are numbered in the Figure. The individual lobes also include plugs 1305 positioned in holes 1304 drilled in each of the lobes. The plugs are anti-friction plugs made of a material that will glide easily over the separation plates between segments. The plugs may be made of metal, plastic or be roller bearings. In a preferred embodiment the plugs are made of Teflon® (Teflon is a registered trademark of E. I. Dupont De Nemours and Company a Delaware corporation).

The exposed plug is fitted to have a slight contact with each separation plate in order to provide stability and eliminate plate vibration. The plugs although shown in a four lobe rotor likewise are usable on rotors with any number of lobes. The plugs fitted in holes drilled in the top and bottom surfaces of the lobe rotors, glide over and lightly contact the separation plates when the lobe rotors rotate.

Helical Lobe Pumps

Starting in the mid-1970's with the advances in machining methods, the helical lobe pump was developed. The curved nesting lobe design, comprising a pair of helical lobes that are mirror images of one another, significantly reduced the magnitude of the pulses but did not eliminate the non-continuous pump flow characteristic. In recent years, several manufacturers realized that a continuous flow, pulsation free helical lobe is possible by increasing the 'pumping chamber isolation region' so as to include the extent of the helical wrap of each lobe.

Currently, four and five helical lobe, non-pulsating pumps are available from several manufacturers. In order for these pumps to be pulsation free, the housing design must provide a 'pump chamber isolation region' (PCIR) that spans the separation angle between the lobes plus the helical wrap angle. In the case of a four lobe design, the angular lobe separation angle is 90° and the helical wrap angle must be 90° requiring a PCIR of 180°. The distance between the two sealing arcs is, by physical geometry equal to the center distance between the two shafts. The inlet and discharge flow area is therefore equal to the rotor height times the distance between the two shaft centers.

A three helical lobe, non-pulsating pump is currently not manufactured because of the geometric limitations related to the PCIR. A three lobe design has a lobe separation angle of 120°. Adding the wrap angle required to seal a volume of flow within the pumping cavity and provide continuous pulse free flow, requires a PCIR of 240° resulting in an unworkably small inlet and discharge opening.

Figure 14:
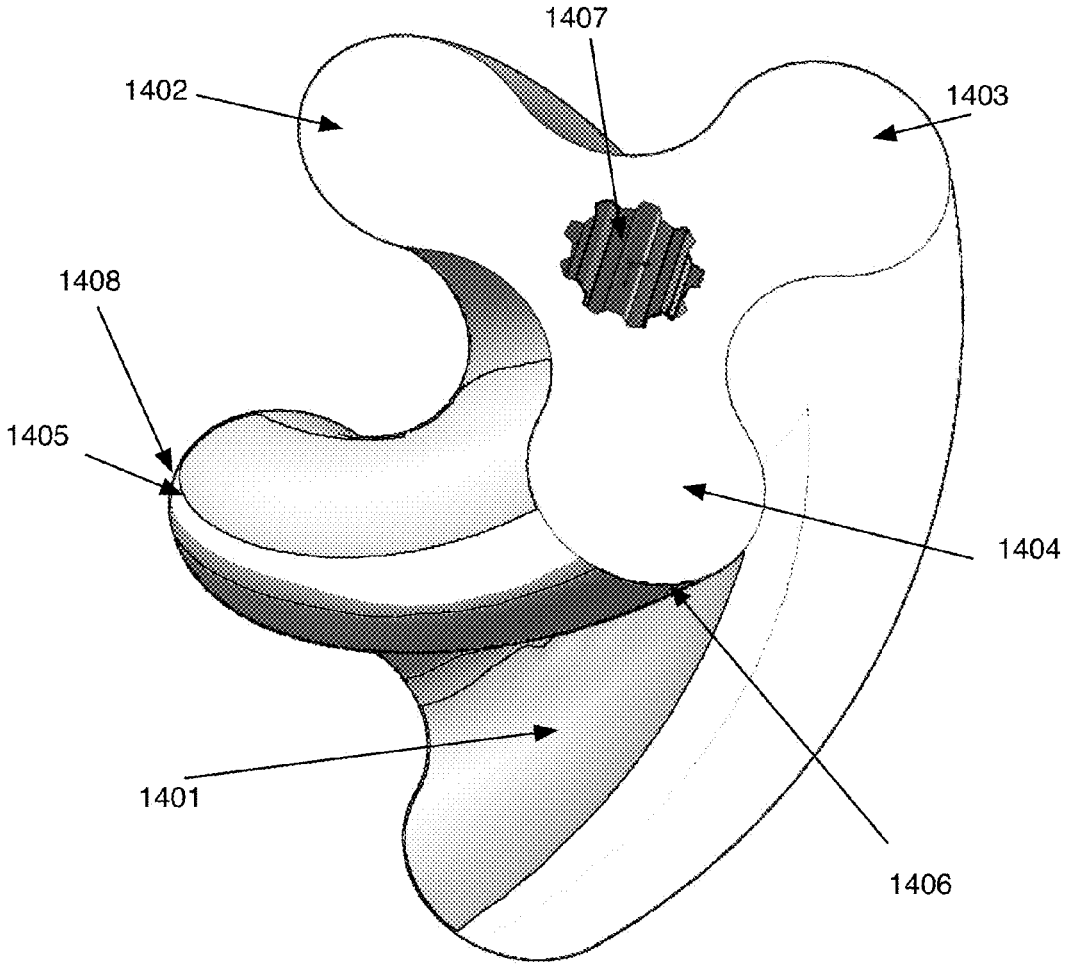
FIG. 14 is a perspective drawing of a helical three lobe pump rotor having a wrap angle of 120 degrees.

Referring to FIG. 14 a three lobe helical rotor 1401 having a wrap angle of 120 degrees is shown. The rotor is comprised of three lobes 1402, 1403, 1404 the lobes are symmetrically placed around the center 1407 of the rotor. The center includes a hole 1407, in this embodiment that is slotted, to receive a shaft to drive the rotor. The rotor is twisted into a helix such that the bottom 1405 point of each rotor is angularly displaced from the top. In the instance shown the point 1408 on the bottom of the lobe 1404 is displaced by 120 degrees from the equivalent point 1406 on the top edge of the lobe 1404. The wrap angle is better shown in the end view of FIG. 17. When used as mirror image pairs in a lobe pump, a helical rotor can provide continuous pulse free flow. The modification from the straight walled lobe rotors is that the pump chamber isolation region must be expanded to account for the wrap of the rotor. For a helical lobe pump the pump chamber isolation region is the separation angle of the lobes plus the wrap angle of the helical rotor. In the case of a single segment three lobe rotor with a 120 degree wrap angle the pump chamber isolation region must equal 240 degrees resulting in very small unworkable inlet and outlet ports. This issue is demonstrated in the cross-sectional view of FIG. 15.

Figure 15:
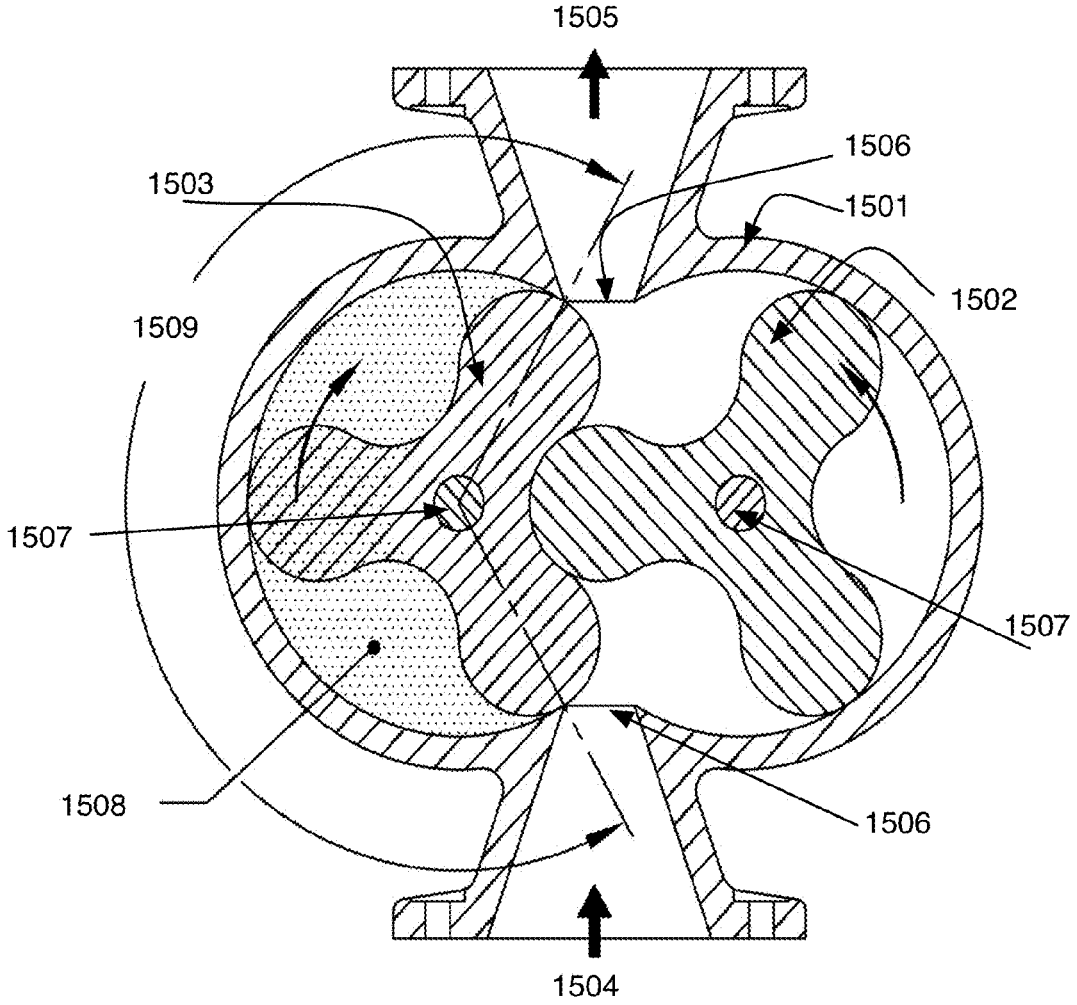
FIG. 15 is a cross-sectional view of a single segment helical three lobe pump showing issues with a pump chamber isolation region required to accommodate a helical three lobe pump with a 120 degree wrap angle in a single segment design.

Referring to FIG. 15 the lobe pump includes many features that have already been discussed in conjunction with non helical lobe pumps. The pump is comprised of a housing 1502 which encloses a pair of rotors 1502, 1503. The rotors in this case are helical and are mirror images of one another, but this attribute is not visible in a cross-sectional view. The rotors are each mounted on shafts 1507 that rotate driving the rotors in the direction shown, for flow in the direction shown. The flow is reversed if the rotation is reversed. The pump further includes an inlet 1504 and an outlet 1505. The pump chamber isolation region 1508 is seen to span an angle 1509 of 240 degrees. This results in constrictions 1506 and that inlet and outlet of the pump. It is because of this geometric constraint that three lobe helical pumps are not commercially available. The solution is the instant invention of a multi segment pump.

Figure 16A:
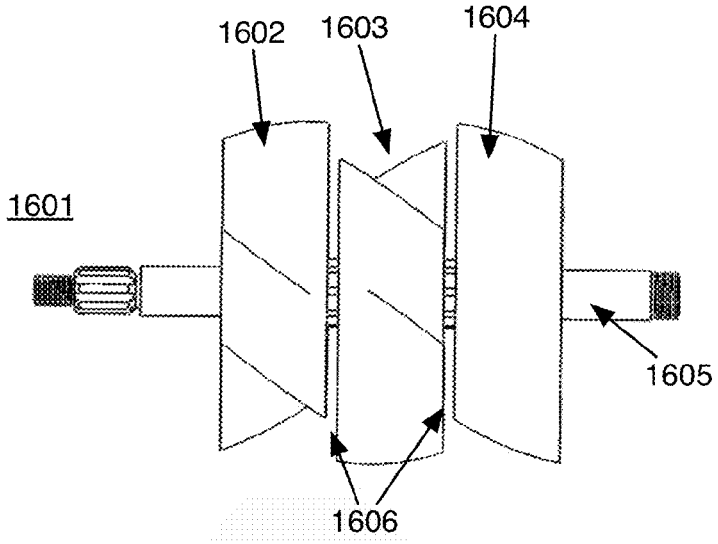
FIG. 16A shows a side view of a three segment three helical lobe rotor.
Figure 16B:
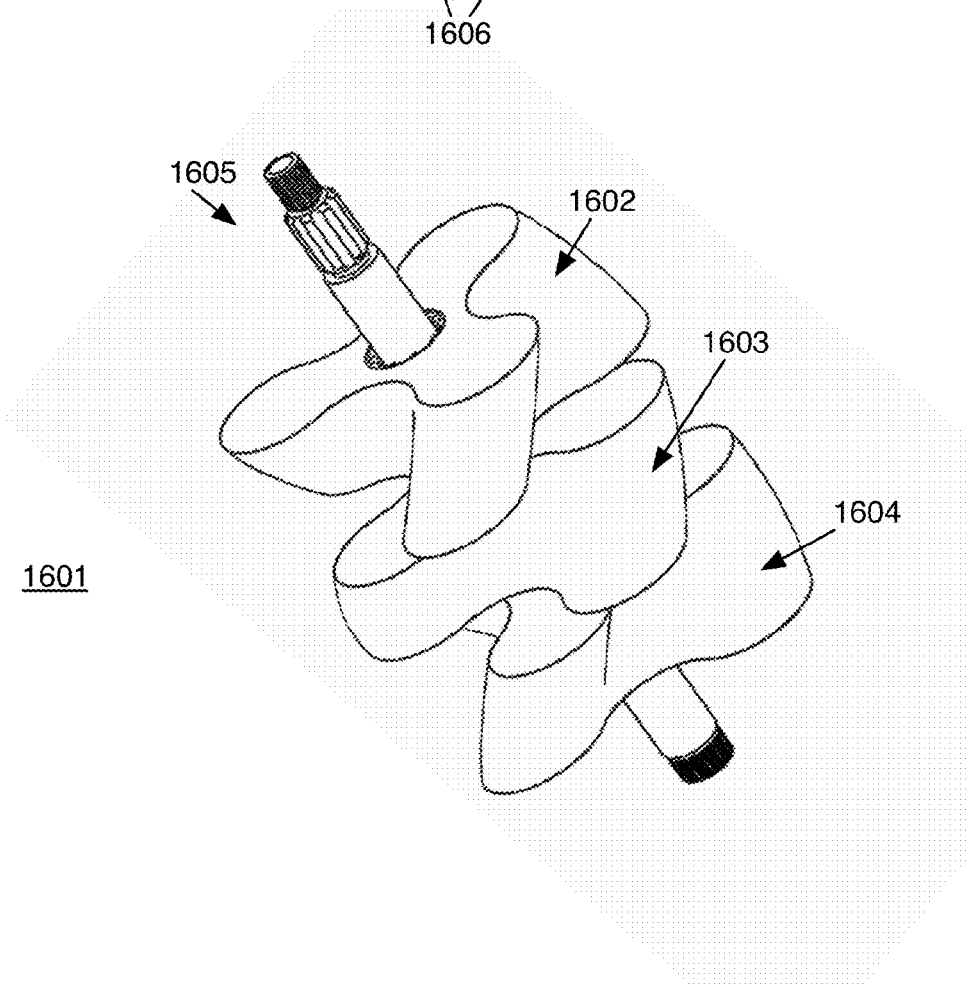
FIG. 16B is a perspective view of the rotor of FIG. 16A.

Referring now to FIGS. 16A and 16B, two views of a rotor assembly 1601 for a three segment helical three lobe pump is shown. In effect the helical rotor with a 120 degree wrap angle, required for continuous flow from the pump, has been cut into three equal segments. The assembly includes three helical rotors 1602, 1603, 1604 with each rotor having a wrap angle of 40 degrees. The rotors are mounted to a shaft 1605. The mounting is such to include spacing 1606 between the rotors to accommodate a separation plate in the final pump assembly. The rotors are seen to be offset or indexed from one another. The index angle between neighboring rotors being the same as for a conventional lobe pump or the angle between the lobes of the rotors divided by the number of segments. In the case shown for a three lobe pump the index angle is 120/3 or 40°.

Figure 17:
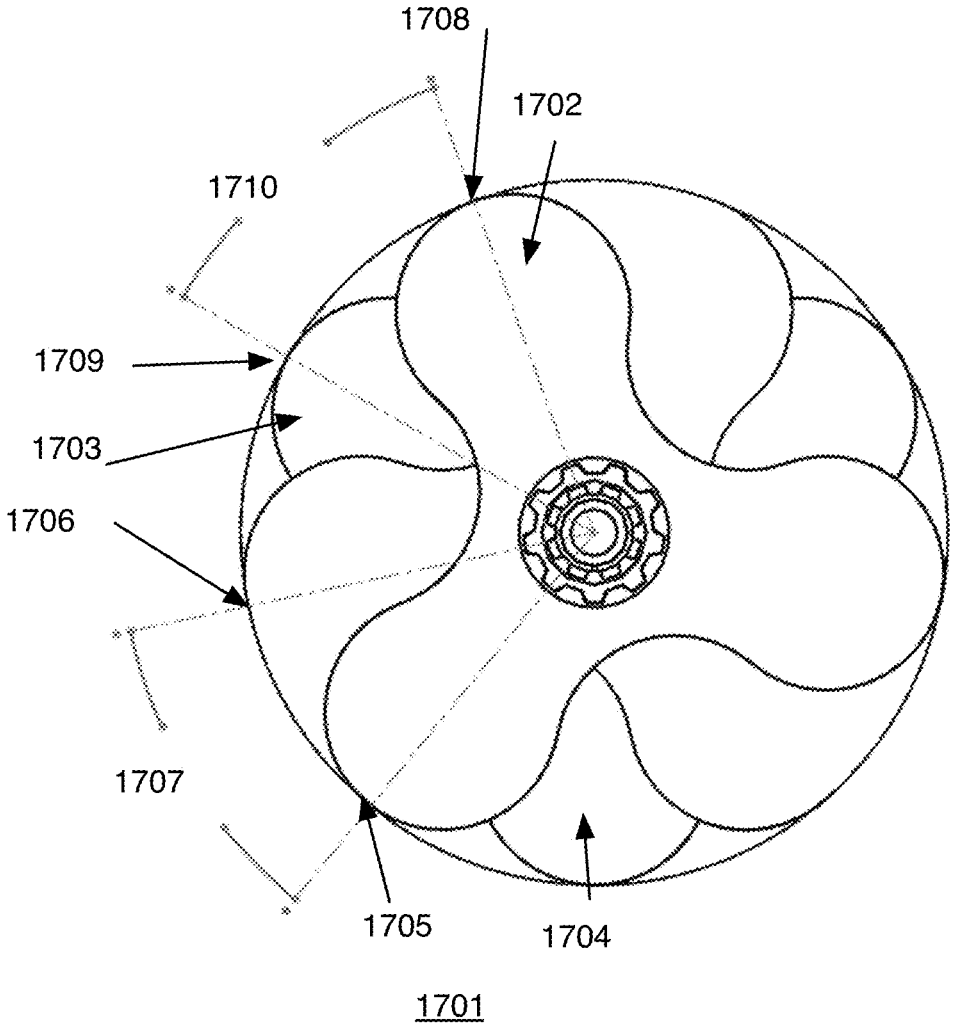
FIG. 17 is a top view of the rotor of FIG. 16A.

An end view of the same rotor assembly is shown in FIG. 17. The assembly is seen to be comprised of three helical lobe rotors the wrap angle is the angular displacement of equivalent points on the top and bottom face of a rotor or in the instance shown the equivalent points 1705, 1706 at the outer tip of the rotor 1702 are rotationally displaced by a wrap angle 1707 of 40°. Adjacent rotors are rotationally indexed from one another by the index angle 1710. That is the points 1709 on the middle rotor 1703 is rotationally displaced from the point 1708 on the top rotor 1702 by the index angle 1710. In the embodiment shown the index angle 1710 is 40 degrees.

Figure 18:
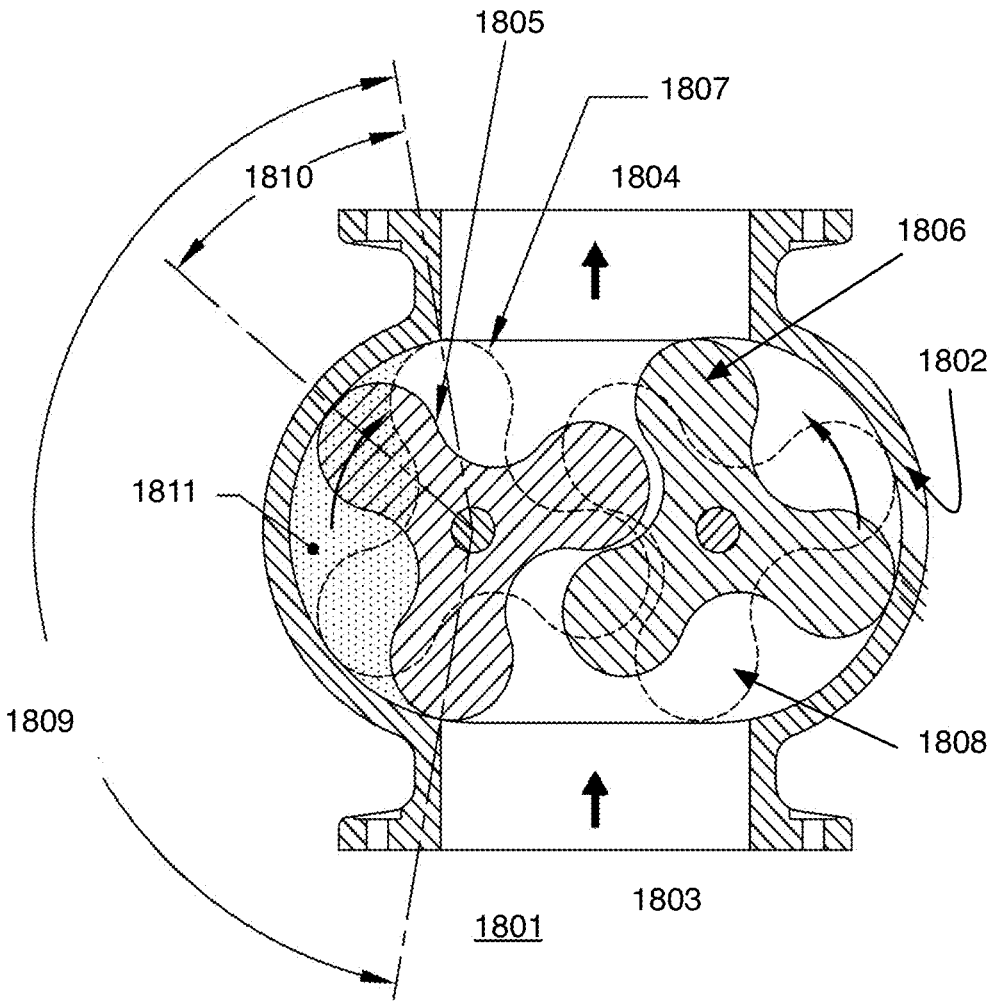
FIG. 18 is a cross-sectional view of a three segment three lobe helical pump.

Referring now to FIG. 18, a cross-sectional view of a three segment, helical three lobe pump is shown. The pump 1801 is comprised of a housing 1802 that includes an entrance 1803 and an exit 1804. The housing encloses the two of the multiple rotor assemblies shown and discussed in FIG. 17. The rotors on each assembly are mirror images of their corresponding meshing rotor on the other assembly. Only the top two of the three segments are shown. The top rotor is cross hatched and the middle level shown in dashed lines. The pump is comprised of helical rotors 1805, 1806 in a first segment and rotors 1807, 1808 in a second segment. The rotors attached to the same drive shaft in adjacent segments are displaced from one another by the index angle 1810. The design shown is a three lobe three segment pump so that the index angle is 40°. The pump chamber isolation region 1811 is defined by its circumscribed angle 1809. In the instant case the PCIR angle is the angle between the lobes on a single rotor or 120 degrees plus the wrap angle of 40 degrees resulting in the PCIR angle 1809 of 160°. Note by contrast with the design shown and discussed in conjunction with FIG. 15, the multiple segment helical pump has PCIR angle of 160° rather than the 240° required with a single segment. The inlet 1803 and outlet 1804 are not constricted in the design of FIG. 18 as they were in the design of FIG. 17.

Although a design for a three segment three helical lobe pump was shown. From the discussion, generalization to any number of lobes, wrap angles and segments should be clear to those skilled in the art.

SUMMARY

Designs for multiple segment lobe pumps are shown. The designs include pumps using rotors having two lobes to a plurality of lobes and segments that include two segments to a plurality of segments. Designs for both vertical or straight walled conventional lobed rotors as well as helical lobe rotors are shown. The designs are applicable to a variety of rotors and number of segments. In one particular case the designs enable a three lobe helical pump.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A lobe pump comprising:

a) a housing having an inlet and an outlet and walls, b) a first shaft and a second shaft, the shafts being elongated cylinders, the first shaft extending beyond a wall of the housing such that it is rotated by a motor, the shafts fixed within the housing such that their long axes are parallel, the shafts coupled through use of timing gears affixed to a first end of each shaft such that rotation of the first shaft by the motor causes the second shaft to rotate, c) a plurality of segments, each segment comprising:

i) a first lobe rotor having a center, a top surface, a bottom surface, sidewalls and a plurality of lobes symmetrically extending from the center, the lobes extended at a lobe separation angle from one another, the first lobe rotor fixedly attached to the first shaft through the center of the first lobe rotor such that rotation of the first shaft causes the first lobe rotor to rotate, ii) a second lobe rotor having a center, a top surface, a bottom surface, sidewalls and a plurality of lobes symmetrically extending from the center, the lobes extended at a lobe separation angle from one another, wherein the first lobe rotor and the second lobe rotor have the same number of lobes and lobe angles, the second lobe rotor fixedly attached to the second shaft through the center of the second lobe rotor such that the rotation of the second shaft causes the second lobe rotor to rotate, iii) separation plates positioned above and below the first lobe rotor and the second lobe rotor adjacent to the top and bottom surfaces of the first lobe rotor and the second lobe rotor, said separation plates acting to physically isolate the segments from one another, iv) the shafts and the first lobe rotor and the second lobe rotor positioned such that the simultaneous rotation of the first lobe rotor and the second lobe rotor results in meshing of the first lobe rotor and the second lobe rotor thereby causes a pumping action wherein a fluid enters a central portion of each of the first lobe rotor and the second lobe rotor at the inlet of the housing, passes through a pump chamber isolation region, and the fluid is displaced from each of the first lobe rotor and the second lobe rotor at the outlet by the second lobe rotor and the first lobe rotor respectively, v) wherein there is a separate pump chamber isolation region for each of the first lobe rotor and the second lobe rotor defined as a volume of space within the housing and delineated by a wall of the housing and the lobe rotor, the pump chamber isolation region having a pump chamber isolation region arc, d) wherein in the plurality of segments, the first lobe rotors attached to the same shaft and in adjacent segments are aligned to be rotationally displaced from one another by an index angle, and the second lobe rotors attached to the same shaft and in adjacent segments are aligned to be rotationally displaced from one another by the index angle, and, e) the pump chamber isolation region arc is equal to the lobe separation angle, and, f) the index angle is equal to the lobe separation angle divided by the number of segments.

2. The lobe pump of claim 1 wherein the top surface and the bottom surface of the first lobe rotors and the second lobe rotors are flat, parallel to one another and perpendicular to the shafts.

3. The lobe pump of claim 1 further including plugs fitted in holes drilled in the top and bottom surfaces of the first lobe rotors and the second lobe rotors, wherein the plugs glide over the separation plates when the first lobe rotors and the second lobe rotors rotate.

4. A rotor assembly for a lobe pump comprising:

a) a first shaft and a second shaft, the shafts being elongated cylinders, the first shaft extending beyond a wall of a housing such that it may be rotated by a motor, the shafts fixed within the housing such that their long axes are parallel, the shafts coupled through use of timing gears affixed to a first end of each shaft such that rotation of the first shaft by the motor causes the second shaft to rotate, b) a plurality of segments, each segment comprising:

i) a first lobe rotor having a center, a top surface, a bottom surface, sidewalls and a plurality of lobes symmetrically extending from the center, the lobes extended at a lobe separation angle from one another, the first lobe rotor fixedly attached to the first shaft through the center of the first lobe rotor such that rotation of the first shaft causes the first lobe rotor to rotate, ii) a second lobe rotor having a center, a top surface, a bottom surface, sidewalls and a plurality of lobes symmetrically extending from the center, the lobes extended at a lobe separation angle from one another, wherein the first lobe rotor and the second lobe rotor have the same number of lobes and lobe angles, the second lobe rotor fixedly attached to the second shaft through the center of the second lobe rotor such that the rotation of the second shaft causes the second lobe rotor to rotate, iii) separation plates positioned above and below the first lobe rotor and the second lobe rotor adjacent to the top and bottom surfaces of the first lobe rotor and the second lobe rotor, said separation plates acting to physically isolate the segments from one another, iv) the shafts and the first lobe rotor and the second lobe rotor positioned such that the simultaneous rotation of the first lobe rotor and the second lobe rotor results in meshing of the first lobe rotor and the second lobe rotor thereby causes a pumping action wherein a fluid enters a central portion of each of the first lobe rotor and the second lobe rotor at the inlet of the housing and the fluid is displaced from each of the first lobe rotor and the second at the outlet by the second lobe rotor and the first lobe rotor respectively, c) wherein in the plurality of segments, the first lobe rotors attached to the same shaft and in adjacent segments are aligned to be rotationally displaced from one another by an index angle, and the second lobe rotors attached to the same shaft and in adjacent segments are aligned to be rotationally displaced from one another by the index angle, and, d) the index angle is equal to the lobe separation angle divided by the number of segments.

5. The rotor assembly of claim 4 wherein the top surfaces and the bottom surfaces of the first lobe rotors and the second lobe rotors are flat, parallel to one another and perpendicular to the shafts.

6. The rotor assembly of claim 4 wherein the first lobe rotors and the second lobe rotors have three lobes on each lobe rotor.

7. The rotor assembly of claim 6 wherein the rotor assembly is comprised of three segments.

8. The rotor assembly of claim 4 further including plugs fitted in holes drilled in the top and bottom surfaces of the first lobe rotors and the second lobe rotors, wherein the plugs glide over the separation plates when the first lobe rotors and the second lobe rotors rotate.

9. A lobe pump comprising:

a) a housing having an inlet and an outlet and walls, b) a first shaft and a second shaft, the shafts being elongated cylinders, the first shaft extending beyond a wall of the housing such that it is rotated by a motor, the shafts fixed within the housing such that their long axes are parallel, the shafts coupled through use of timing gears affixed to a first end of each shaft such that rotation of the first shaft by the motor causes the second shaft to rotate, c) a plurality of segments, each segment comprising:

i) a first lobe rotor having a center, a top surface, a bottom surface, sidewalls and a plurality of lobes symmetrically extending from the center, the lobes extended at a lobe separation angle from one another, the first lobe rotor fixedly attached to the first shaft through the center of the first lobe rotor such that rotation of the first shaft causes the first lobe rotor to rotate, ii) a second lobe rotor having a center, a top surface, a bottom surface, sidewalls and a plurality of lobes symmetrically extending from the center, the lobes extended at a lobe separation angle from one another, wherein the first lobe rotor and the second lobe rotor have the same number of lobes and lobe angles, the second lobe rotor fixedly attached to the second shaft through the center of the second lobe rotor such that the rotation of the second shaft causes the second lobe rotor to rotate, iii) separation plates positioned above and below the first lobe rotor and the second lobe rotor adjacent to the top and bottom surfaces of the first lobe rotor and the second lobe rotor, said separation plates acting to physically isolate the segments from one another, iv) the shafts and the first lobe rotor and the second lobe rotor positioned such that the simultaneous rotation of the first lobe rotor and the second lobe rotor results in meshing of the first lobe rotor and the second lobe rotor thereby causes a pumping action wherein a fluid enters a central portion of each of the first lobe rotor and the second lobe rotor at the inlet of the housing, passes through a pump chamber isolation region, and the fluid is displaced from each of the first lobe rotor and the second lobe rotor at the outlet by the second lobe rotor and the first lobe rotor respectively, v) wherein there is a separate pump chamber isolation region for each of the first lobe rotor and the second lobe rotor defined as a volume of space within the housing and delineated by a wall of the housing and the lobe rotor, the pump chamber isolation region having a pump chamber isolation region arc, d) wherein in the plurality of segments, the first lobe rotors attached to the same shaft and in adjacent segments are aligned to be rotationally displaced from one another by an index angle, and the second lobe rotors attached to the same shaft and in adjacent segments are aligned to be rotationally displaced from one another by the index angle, and, e) the first lobe rotors and the second lobe rotors are helical lobe rotors, each having a wrap angle, and, f) the pump chamber isolation region arc is equal to the lobe separation angle plus the wrap angle, and, g) the index angle is equal to the lobe separation angle divided by the number of segments.

10. The lobe pump of claim 9 wherein the first lobe rotors and the second lobe rotors have three lobes on each lobe rotor.

11. The lobe pump of claim 10 wherein the lobe pump is comprised of three segments.

12. A rotor assembly for a lobe pump comprising:

a) a first shaft and a second shaft, the shafts being elongated cylinders, the first shaft extending beyond a wall of a housing such that it may be rotated by a motor, the shafts fixed within the housing such that their long axes are parallel, the shafts coupled through use of timing gears affixed to a first end of each shaft such that rotation of the first shaft by the motor causes the second shaft to rotate, b) a plurality of segments, each segment comprising:

i) a first lobe rotor having a center, a top surface, a bottom surface, sidewalls and a plurality of lobes symmetrically extending from the center, the lobes extended at a lobe separation angle from one another, the first lobe rotor fixedly attached to the first shaft through the center of the first lobe rotor such that rotation of the first shaft causes the first lobe rotor to rotate, ii) a second lobe rotor having a center, a top surface, a bottom surface, sidewalls and a plurality of lobes symmetrically extending from the center, the lobes extended at a lobe separation angle from one another, wherein the first lobe rotor and the second lobe rotor have the same number of lobes and lobe angles, the second lobe rotor fixedly attached to the second shaft through the center of the second lobe rotor such that the rotation of the second shaft causes the second lobe rotor to rotate, iii) separation plates positioned above and below the first lobe rotor and the second lobe rotor adjacent to the top and bottom surfaces of the first lobe rotor and the second lobe rotor, said separation plates acting to physically isolate the segments from one another, iv) the shafts and the first lobe rotor and the second lobe rotor positioned such that the simultaneous rotation of the first lobe rotor and the second lobe rotor results in meshing of the first lobe rotor and the second lobe rotor thereby causes a pumping action wherein a fluid enters a central portion of each of the first lobe rotor and the second lobe rotor at the inlet of the housing and the fluid is displaced from each of the first lobe rotor and the second at the outlet by the second lobe rotor and the first lobe rotor respectively, c) wherein in the plurality of segments, the first lobe rotors attached to the same shaft and in adjacent segments are aligned to be rotationally displaced from one another by an index angle, and the second lobe rotors attached to the same shaft and in adjacent segments are aligned to be rotationally displaced from one another by the index angle, and, d) the first lobe rotors and the second lobe rotors are helical lobe rotors, each having a wrap angle, and, e) the index angle is equal to the lobe separation angle divided by the number of segments.

* * * * *